United States Patent [19]

Bratkowski et al.

[11] 4,158,827

[45] Jun. 19, 1979

[54] CURRENT LIMITING CONTACTOR

[75] Inventors: Walter V. Bratkowski, McKeesport; Kurt A. Grunert, Beaver, both of Pa.

[73] Assignee: Westinghouse Electric Corp., Pittsburgh, Pa.

[21] Appl. No.: 808,573

[22] Filed: Jun. 21, 1977

[51] Int. Cl.[2] ..... H01H 77/10

[52] U.S. Cl. ..... 335/16; 335/195

[58] Field of Search ..... 335/16, 15, 194, 195, 335/147

[56] References Cited

U.S. PATENT DOCUMENTS

| | | | |
|---|---|---|---|
| 3,555,471 | 1/1971 | Mitskevich et al. | 335/195 |
| 3,593,227 | 7/1971 | Mitskevich et al. | 335/195 X |

*Primary Examiner*—George Harris
*Attorney, Agent, or Firm*—L. P. Johns

[57] ABSTRACT

A current limiting contactor characterized by stationary and movable contacts, an elongated conductor supporting the movable contact, the conductor being fixedly mounted at a position spaced from the movable contact, the conductor having a looped portion including a pair of overlapping segments for conducting current in opposite directions of each other, the movable contact engaging the stationary contact when conducting a current up to a predetermined current value, and the conductor being comprised of a flexible material and the overlapping portions being separable to move the movable contact away from the stationary contact when the current exceeds said predetermined value.

9 Claims, 8 Drawing Figures

CURRENT LIMITING CONTACTOR

BACKGROUND OF THE INVENTION

1. Field of the Invention

This invention relates to a current limiting contactor and more particularly, it pertains to a cantilevered single break current limiting contactor.

2. Description of the Prior Art

Contactors, fuses, circuit breakers, and magnetic and thermal overload relays are all part of industrial motor control systems. The essential functions of industrial motor control are starting, stopping, speed regulation, and protection of electric motors. Contactors are devices, generally magnetically activated, for repeatedly establishing and interrupting an electrical power circuit. Usually contactors must be able to interrupt up to six times a full load current. However, they do not have any built-in intelligence to sense and react to protect themselves against severe overloads or short circuits. Fuses are generally provided for motor circuits for overload or short circuit conditions, But, the current rating of the fuse must be considerably higher than the current rating of the motor or the fuse will blow when the motor is started. As a result, fuses do not provide adequate overload protection for motors. Furthermore, contactors must withstand severe overloads in short circuit currents while the fuse is melting. This generally results in welded contacts as well as a blown fuse. Both the contacts and the fuse must be replaced before the equipment can be used again.

Current limiting can be accomplished by generating a rapid rise in current voltage up to the system voltage. When the arc voltage has reached or exceeded the system voltage, the current will peak and be forced to zero before the first normal current zero. The peak current and the $I^2t$ let through are therefore direct functions of how rapidly the arc voltage is generated. A rapid rise in arc voltage can be accomplished by separating contacts rapidly and by stretching the arc with a magnetic field.

SUMMARY OF THE INVENTION

It has been found in accordance with this invention that problems inherent in the prior art may be overcome by providing a current limiting contactor comprising an insulating housing, a stationary contact structure in the housing, a movable contact structure in the housing, means for moving the movable contact structure between open and closed positions relative to the stationary contact structure, the movable contact structure comprising an elongated conductor, a movable contact mounted on one portion of the conductor, a second portion of the conductor and spaced from said one portion being fixedly mounted, the conductor having a looped portion including a pair of overlapping segments for conducting current in opposite directions of each other, the overlapping segments being electrically insulated of each other, one segment extending substantially parallel to the other segment, the movable contact being in contact with the stationary contact structure when conducting a current up to a predetermined value, and the conductor being comprised of a flexible material and the overlapping segments being separable to move the contact away from the stationary contact structure when a current exceeds said predetermined value.

The advantage of the current limiting contactor of this invention is that a cantilevered conductor carrying a movable contact rapidly separates the movable and stationary contacts due to a large repulsion force which occurs between the conductor segments. As the contacts separate, other magnetic fields also generated by the fault current, stretch an arc between the contacts and rapidly drive it off the contacts. Accordingly, the resulting contactor, being composed of fewer parts than contactors of prior construction, is a less costly contactor to manufacture.

DESCRIPTION OF THE PREFERRED EMBODIMENTS

Figure 1:
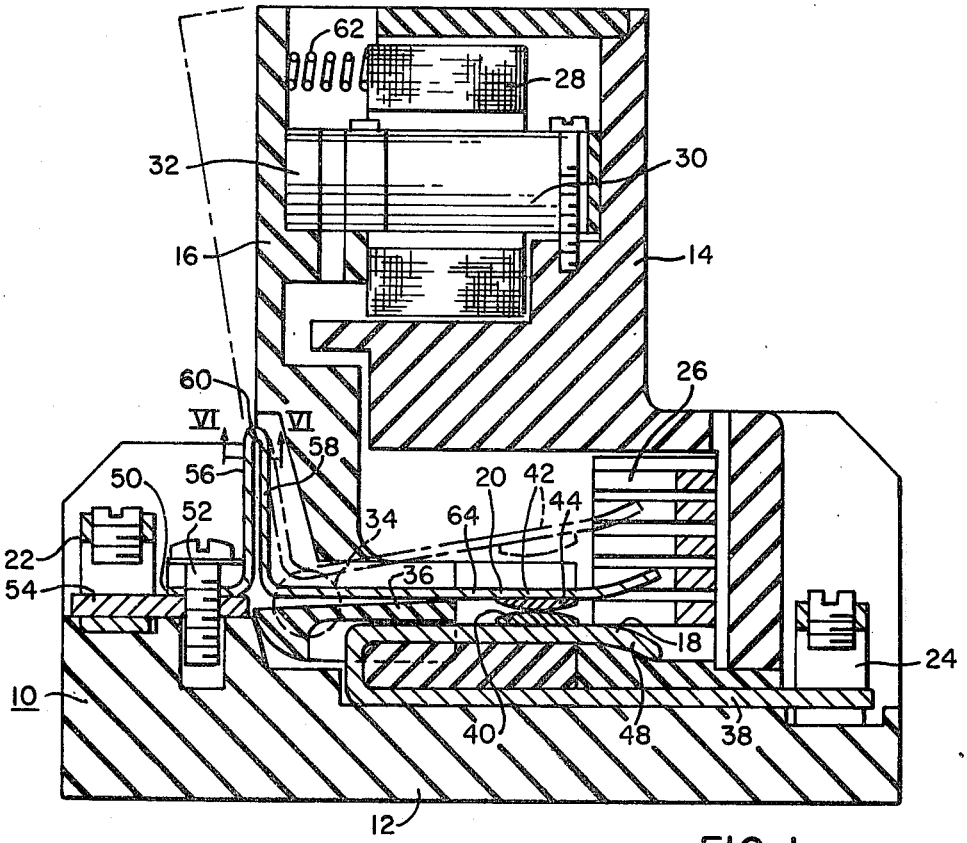
FIG. 1 is a vertical sectional view of an electromagnetic contactor taken on the line I—I of FIG. 2.

In FIG. 1 a current limiting contactor is generally indicated at 10 and it comprises a base 12, a cover 14, an armature support 16, a stationary contact structure 18, and a movable contact structure 20.

Figure 2:
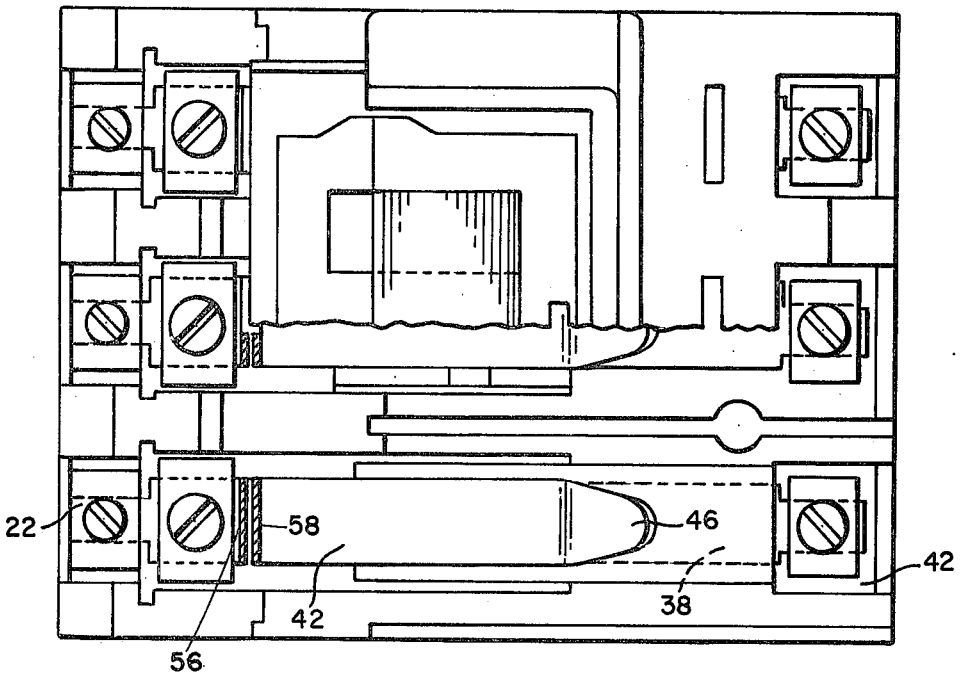
FIG. 2 is a plan view, partly in section, of the contactor shown in FIG. 1.

As shown in FIGS. 1 and 2, contactor 10 is a three-pole circuit interrupting device of which the base 12 and the cover 14 are composed of a dielectric material. The base 12 serves as a housing for the stationary contact structure 18 and the movable contact structure 20 which structures extend between a line terminal connector 22 and a load terminal connector 24. An arc chute 26 is contained within the base in a conventional manner.

The cover 14, being detachably mounted on the base 12 by suitable means, such as screws (not shown), encloses an electromagnetic structure including a coil 28 and a core 30. An armature 32, comprising the third component of the electromagnetic structure, is fixedly mounted on the armature support 16 which in turn is pivotally mounted at pivot 34 on the base 12. The armature support 16 is also comprised of a dielectric material. A lower portion 36 of the armature support 16 extends between the contact structures 18, 20.

The stationary contact structure 18 comprises an elongated conductor 38 and a stationary contact 40. The movable contact structure 20 comprises an elongated conductor 42 and a movable contact 44. The movable contact 44 is secured to the conductor 42 and the latter includes a tapered end portion 46 corresponding to a similar end portion 48 of the stationary conductor 38. The end portions 46, 48 combine with the arc chute 27 to blow an arc occurring between the contacts 40, 44 into the arc chute 26 in a conventional manner.

In accordance with this invention, the conductor 42 comprises an end portion 50 which is secured in place by suitable means, such as a screw 52, whereby the conductor is secured to a portion of the base 12 as well as to a terminal conductor 54. The end portion 50 is remotely spaced from the movable contact 44. Thus, the conductor 42 extends as a cantilever from the screw 52 and across the base 12 to the arc chute 26.

In addition, this invention is directed to a looped portion of the conductor 42 which portion comprises a pair of segments 56, 58 which extend transversely of the conductor 42 and with the upper ends including a bend or U-shaped portion 60. The conductor 42 is an integral unit embodying the end portion 50, the segments 56, 58, the U-portion 60, as well as the tapered end portion 46 with the movable contact 44 secured in a suitable manner such as by a brazed or welded connection.

The conductor segments 56, 58 are electrically insulated from each other either by an air space or by having a dielectric coating of a varnish or similar material.

In operation during normal periods of use, the circuit through the contactor 10 extends from the terminal 22 through the terminal conductor 54, the conductor 42, the contacts 44, 40, and the conductor 38 to the terminal connector 24. Upon the occurrence of an unpredicted overcurrent, such as overloads and short circuits, repelling magnetic fluxes occur in the adjacent segments 56, 58 resulting in magnetic repulsion forces between them and driving them apart, thereby lifting the movable contact 44 off of the contact 40 to the broken line position of the conductor 42 as shown in FIG. 1. That is, the segment 58 is moved away from the segment 56 by the magnetic repulsion force between them with the segment 58 pivoting about the U-portion 60. Upon cessation of the overload, the conductor 42 returns to the closed position of the contacts 40, 44.

The provision of the cantilevered, loop conductor 42 for handling overloads does not interfere with the conventional operation of the contractor 10. The contacts 40, 44 are readily opened or closed in normal operation by energizing or deenergizing of coil 28. Manifestly, when the coil 28 is energized, the armature 32 is attracted to the core 30 and the armature support 16 rotates around the pivot 34 to close the contacts 40, 44. Conversely, when the coil 28 is deenergized, bias means, such as coil spring 62, move the armature support 16 counterclockwise around the pivot 34 and cause the lower portion 36 of the armature support to lift the conductor 42 at their point of contact 64, thereby opening the contacts 40, 44.

Figure 3:
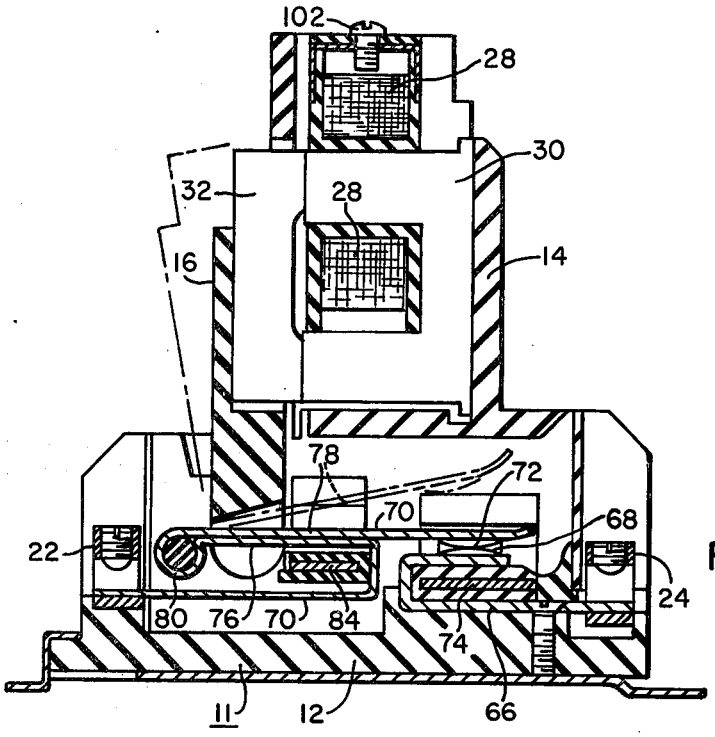
FIG. 3 is a vertical sectional view of another embodiment of the contactor.

Another embodiment of the invention is shown in FIG. 3 in which similar numbers refer to similar parts. The embodiment of the contactor 11 (FIG. 3) comprises a stationary contact structure including an elongated conductor 66 and a stationary contact 68. A movable contact structure comprises an elongated conductor 70 and a movable conductor 66 72. The elongated contact extends from the load terminal connector 24 to the stationary contact 68 and has a generally U-shaped configuration. A slot motor 74 is located between the spaced portions of the U-shaped conductor 66. The slot motor operates on a principle similar to that disclosed in U.S. Pat. No. 3,815,059 and is provided for driving an arc away from the contacts 68, 72 when the contacts are open.

The conductor 70 is a generally U-shaped member having a looped portion including overlapping and generally parallel segments 76, 78 form a bend or substantially circular turn-around portion 80. The overlapping segments 76, 78 forming the looped portion are disposed on an axis substantially parallel to or aligned with the conductor 70 on which the movable contact 72 is mounted. In operation, when an overload or short circuit occurs, the segments 76, 78 are separated by a magnetic repulsion force so that the conductor 70 including the segment 78 moves upwardly to the broken line position, as shown in FIG. 3, thereby opening the contacts 68, 72.

In FIG. 3, a second slot motor 84 may be provided in conjunction with the conductor 70 to cause it to move upwardly in response to an overload of a predetermined value which segments 76, 78 would not otherwise separate in response to a sufficiently large magnetic repulsion force.

Figure 4:
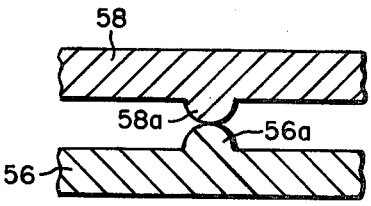
FIGS. 4–7 are horizontal sectional views of various embodiments of the loop section of the conductor taken on the line V—V of FIG. 1.

In FIGS. 4, 5, 6, and 7 the cross-sectional views of the associated segments 56, 58 (or the segments 76, 78) are shown. The segments 56, 58, as shown in FIG. 4, may be provided with opposed projecting ribs **56*a*, 58*a*, respectively, to concentrate the currents between the segments and thereby enhance the separation of the segments 56, 58** due to a concentration of the magnetic repulsion forces at the rib locations.

Figure 5:
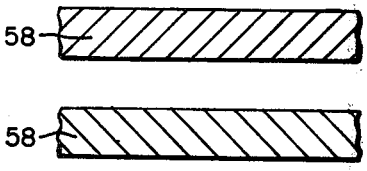

In FIG. 5 the segments 56, 58 may be separated merely by an air space between them which construction may be suitable for certain conditions inherent in a particular contactor.

Figure 6:
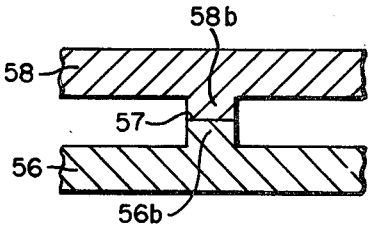

In FIG. 6 the segments 56, 58 may be provided with projections or ribs **56*b*, 58*b*, respectively, which ribs are of rectangular cross-section as compared with the ribs 56*a*, 58*a*, and which ribs may be in surface-to-surface engagement at 57**.

Figure 7:
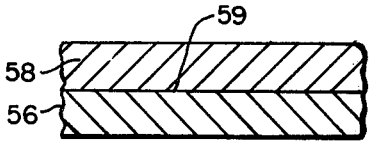

As shown in FIG. 7 the segments 56, 58 may also be in contact at 59. Where the segments 56, 58 are not separated by an insulating air gap, such as in FIG. 5, the surfaces forming the contacts such as at 57, 59 are provided with insulating coatings such as a lacquer.

Figure 8:
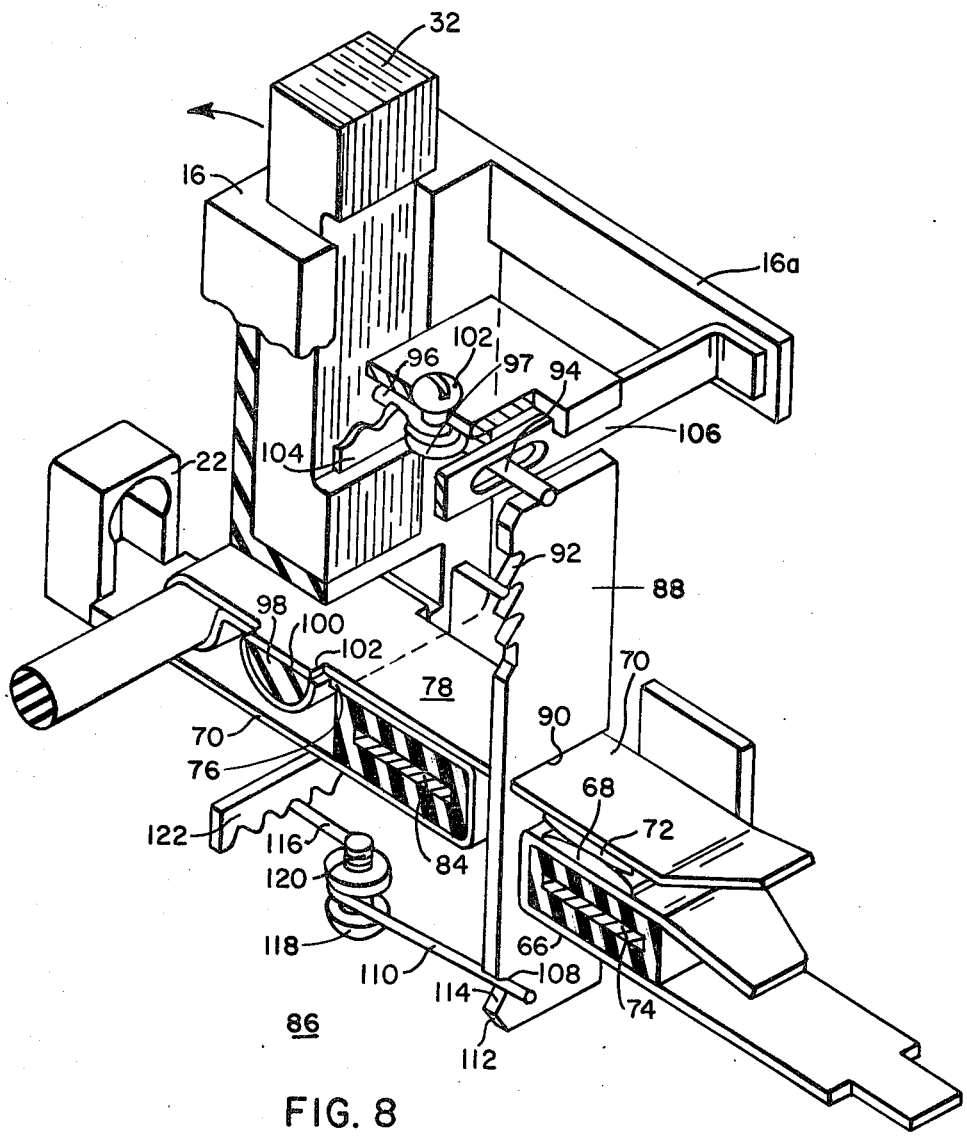
FIG. 8 is an isometric view, with a portion broken away, of a current limiting contactor of another embodiment.

In FIG. 8, another embodiment includes parts having reference numbers similar to those of the contactor 11 in FIG. 3. More particularly, the contactor 86 of FIG. 8 comprises a shutter 88 which is movable vertically with the conductor 70. The shutter 88 is an elongated strip comprised of a dielectric material and having a slot 90 through which the conductor 70 extends. When the contacts 68, 72 separate and the resulting arc is extinguished, any ionized gas developed by the arc is prevented by the shutter 88 from moving to the other side of the shutter which would cause the arc to restrike between the conductor segments 76 and 78.

The shutter 88 comprises a latch mechanism including a ratchet having notches 92 on the upper end of the shutter. The mechanism also includes a locking pawl 94 that comprises one end operative with the ratchet, another end portion 96, and an intermediate portion 97. The pawl 94 is a flexible wire-like member disposed in the path of movement of the notches 92 to latch the shutter 88 in an upper position when the conductor 70 rises to an open-contact position. The latch mechanism holds the shutter and the conductor up.

When the contacts 68, 72 are opened due to deenergizing of the coil 28, the armature support 16 rotates about a pivot 98. An upper surface 100 of the pivot abuts an outturned tab 102 of the segment 78 to lift the segment 78, when the current limiting condition is not operative. In turn, the segment 78 lifts the shutter 88 and the pawl 94 engages one of the notches 92 to hold the segment up.

The pressure applied by the pawl 94 on the ratchet notches 92 is dependent upon the position of the pawl end 96. The intermediate portion 97 of the pawl is a coil spring around a pawl-mounting screw 102. A notched ratchet 104, embedded in the upper end of the cover 14, provides a variety of positions for the pawl end portion 96.

Release of the latching pawl 94 is provided by a slide 106 between the screw 102 and the ratchet 92 and having a hole through which the pawl extends. The armature support 16 comprises a reset arm 16a that bears against the right end (FIG. 8) of the slide 106 when the coil 28 is activated, thereby moving the slide to the left to disengage the pawl and allowing the contacts 68, 72 to close.

To hold the contacts 68, 72 tightly together, the shutter 88 is also provided with a hold-down structure comprising a notch 108 and a locking pawl 110. The notch 108 is in the shutter 88 and comprises outwardly and inwardly inclined surfaces 112 and 114 to facilitate sliding of the pawl into and out of notch 110. The pawl 108 also comprises an opposite end 116 and an intermediate or coiled portion 118 secured to the underside of the base 12 by a screw 120. Like the pawl end 96, the pawl end 116 engages a ratchet 122 embedded in the base 12 to enable adjustment of the pressure of the pawl 108 in the notch 110. The pressure applied by the hold-down structure is sufficient for the purpose intended, but is not enough to prevent operation of the current limiting function of this invention.

In addition, when the contacts 68, 72 open in response to the current limiting function, the latching pawl 94 remains inoperative due to the slide 106 unless the coil 28 is also inactivated. The shutter 88 does not hold the contacts 68, 72 open when the coil 28 remains operative.

In conclusion, a new and improved repulsion scheme for rapidly separating contacts is provided. The phenomenon of repulsion is usually associated with short circuit conditions and its fact frequently catastrophic. The enormous forces generated during a short circuit have not been successfully harnessed in the manner disclosed herein. When operating as a contactor, the electromagnetic is energized to close the contacts and deenergized to open the contacts. When operating in the current limiting mode, the contacts are closed. When subjected to a short circuit for severe overload, the contacts are rapidly opened and the cantilevers latch in the open position. The overload current at which the cantilever opens the contacts can be designed at some fixed multiple of rated current. The threshold current is also adjustable and the resetting or unlatching can be manual or remote.

What is claimed is:

1. A current limiting contactor comprising a stationary contact structure, a movable contact structure, movable contact structure means for moving contact structure between open and closed positions relative to the stationary contact structure, the movable contact structure comprising an elongated conductor, a movable contact mounted on one portion of the conductor, a second portion of the conductor and spaced from said one portion being fixedly mounted, the conductor having a looped portion including a pair of integral, unhinged overlapping segments for conducting current in opposite directions of each other, the movable contact being in contact with the stationary contact structure when conducting a current up to a predetermined value, and the conductor being comprised of a flexible material and the overlapping segments being separable to move the movable contact away from the stationary contact structure when the current exceeds said predetermined value.

2. The contactor of claim 1 in which the overlapping segments are electrically insulated.

3. The contactor of claim 2 in which one segment extends substantially parallel to the other segment.

4. The contactor of claim 3 in which the looped portion extends substantially laterally of said second portion.

5. The contactor of claim 3 in which the looped portion is aligned with said second portion.

6. The contactor of claim 3 in which the segments comprise longitudinally-extending ribs.

7. The contactor of claim 2 in which the segments comprise a coating of electrically insulating material.

8. The contactor of claim 1 in which the means for moving the movable contact structure comprises electromagnetic means for moving the movable contact structure to one of the positions, and biasing means for holding the movable contact structure to the other of the positions.

9. The contactor of claim 8 in which the biasing means holds the movable contact structure in the open position.

* * * * *